US005299588A

United States Patent [19]

MacLeod

[11] Patent Number: 5,299,588

[45] Date of Patent: Apr. 5, 1994

[54] FLOATABLE SUNSHADE ASSEMBLY

[76] Inventor: Donna R. MacLeod, P.O. Box 1926, Wimberly, Tex. 78676

[21] Appl. No.: 899,893

[22] Filed: Jun. 17, 1992

[51] Int. Cl.[5] ..... A45B 23/00

[52] U.S. Cl. ..... 135/16; 441/130; 441/131; 472/128

[58] Field of Search ..... 135/16 OR; 441/1, 130, 441/131; 472/128

[56] References Cited

U.S. PATENT DOCUMENTS

| | | | |
|---|---|---|---|
| 2,051,281 | 12/1936 | Webber | 441/131 |
| 2,529,745 | 11/1950 | Stanley | 135/16 |
| 2,727,366 | 12/1955 | Hagen | 135/16 |
| 3,145,720 | 8/1964 | Torii | 135/74 |
| 3,656,749 | 4/1972 | Reyes | 441/1 |
| 3,984,888 | 10/1976 | DeLano | 297/354 |
| 4,205,785 | 6/1980 | Stanley | 472/128 |
| 4,564,240 | 1/1986 | Thieme | 297/460 |
| 4,771,722 | 9/1988 | Tihany | 441/131 |
| 4,789,200 | 12/1988 | Munguia | 297/194 |
| 4,799,910 | 1/1989 | Kellough | 441/131 |
| 5,143,107 | 9/1992 | Kelley | 135/16 |

FOREIGN PATENT DOCUMENTS

| | | | |
|---|---|---|---|
| 379869 | 8/1923 | Fed. Rep. of Germany | 441/130 |
| 322299 | 12/1929 | United Kingdom | 441/131 |

*Primary Examiner*—Carl D. Friedman
*Assistant Examiner*—Wynn E. Wood
*Attorney, Agent, or Firm*—S. Michael Bender

[57] ABSTRACT

The combination of a sunshade and a floatable support member or platform for the sunshade for use in swimming pools or the like. In an alternative embodiment, the floatable support member is adapted to serve as a seat for a person whereas in yet still another alternative embodiment, the floatable support member is adapted to serve as a refreshment stand or convenient storage facility.

2 Claims, 5 Drawing Sheets

FLOATABLE SUNSHADE ASSEMBLY

BACKGROUND OF THE INVENTION

1. Field of the Invention

The present invention relates generally to support structures and more particularly, to a floatable support member for sunshades, umbrellas, or the like.

2. Description of the Prior Art

Various devices have been proposed for supporting umbrellas. For example, in U.S. Pat. No. 3,904,161 there is disclosed a clamp for mounting an umbrella on the tubular frame of a folding chair. Similarly, in U.S. Pat. No. 4,789,200, there is shown a bracket assembly for supporting the shank of an umbrella on the rear surface of a foldable chair, which latter, in turn, is mounted on the deck of a boat. In addition, there have been many attempts to provide a chair capable of floating on the surface of the water. Examples of the latter type of device are described in U.S. Pat. Nos. 3,984,888; 4,564,240; and U.S. Pat. No. De. 290,108.

SUMMARY OF THE INVENTION

A need exists for a sunshade or umbrella that is capable of being floated on the surface of the water. Such a device can provide shade to swimmers in an outdoor swimming pool or similar body of water, and is especially useful in connection with patients undergoing rehabilitation or therapy, young children, or anyone else benefitting from being able to bathe or swim without being exposed to the harmful rays of the sun.

Briefly described, the present invention contemplates a stable support member capable of floating on the surface of water as in a swimming pool, for example, combined with a sunshade, umbrella, or the like. The floating support member not only supports the raised sunshade thereby shielding swimmers from the sun, but furthermore serves as a paddle board or floating raft which may be grasped by the swimmers, thus adding to their security and enjoyment in the water. Several alternatively preferred variations are within the compass of the present invention including a floatable support member adapted to serve as seat for a person, a floatable support member adapted to serve as "floating refreshment stand," and a support member adapted to be combined with a conventional inflated "inner tube" to form the floatable sunshade support assembly.

The above brief description sets forth rather broadly the more important features of the present invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least four embodiments of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention of the application, which only is measured by the claims, nor is it intended to be limiting as to the scope of the invention in any way.

It is therefore an object of the present invention to provide a new and improved floatable sunshade assembly which has all the advantages of the prior art and none of the disadvantages thereof.

It is another object of the present invention to provide a new and improved floatable sunshade assembly which may be easily and efficiently manufactured and marketed.

It is a further object of the present invention to provide a new and improved floatable sunshade assembly which is of a durable and reliable construction.

An even further object of the present invention is to provide a new and improved floatable sunshade assembly which is susceptible of a low cost of manufacture with regard to both materials and labor, and which accordingly is then susceptible of low prices of sale to the consuming public, thereby making such floatable sunshade assembly economically available to the buying public.

Still yet another object of the present invention is to provide a new and improved floatable sunshade assembly which provides in the apparatuses and methods of the prior art some of the advantages thereof, while simultaneously overcoming some of the disadvantages normally associated therewith.

Still another object of the present invention is to provide a new and improved floatable sunshade assembly wherein the support member serves as paddle board.

Yet still another object of the present invention is to provide a new and improved floatable sunshade assembly wherein the support member serves as a seat for a person.

Yet still another object of the present invention is to provide a new and improved floatable sunshade assembly wherein the support member serves as a floating refreshment stand.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had now to the accompanying drawings and descriptive matter in which there are illustrated preferred embodiments of the invention.

BRIEF DESCRIPTION OF THE DRAWINGS

The invention will be better understood and the above objects as well as objects other than those set forth above, will become apparent when consideration is given to the following detailed description thereof. Such description makes reference to the annexed drawings wherein.

DESCRIPTION OF THE PREFERRED EMBODIMENT

With reference now to the drawings, a new and improved floatable sunshade assembly embodying the principles and concepts of the present invention will be described.

Figure 1:
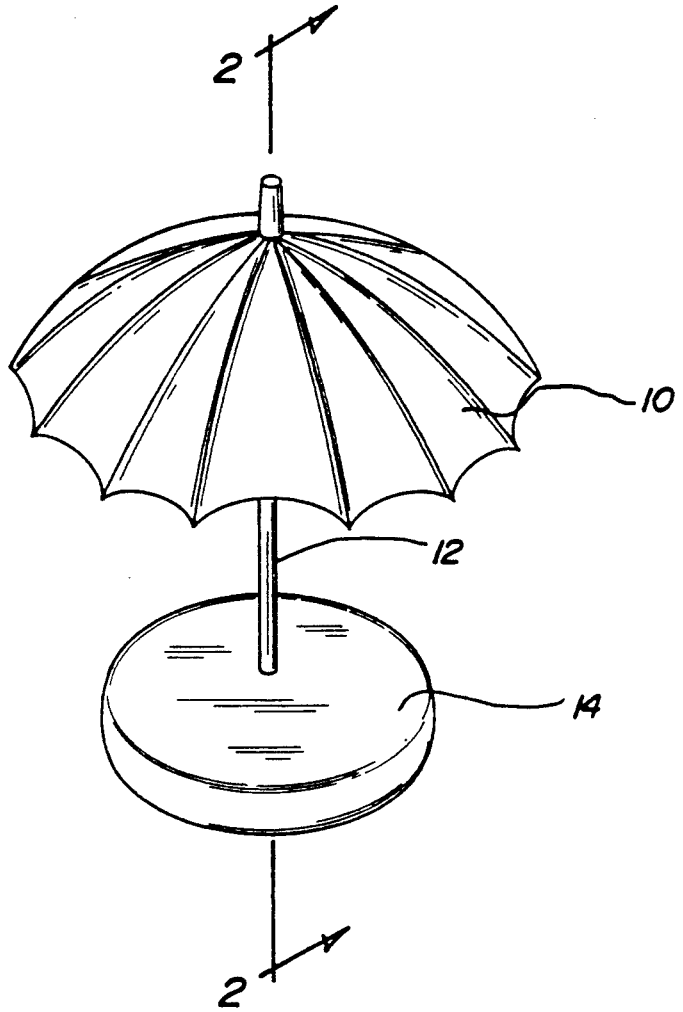
FIG. 1 is a perspective view in elevation of a first preferred form of the floatable sunshade assembly according to the invention.
Figure 2:
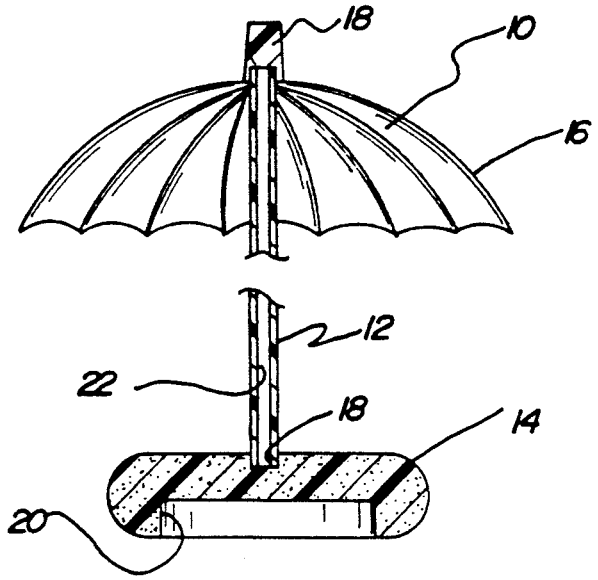
FIG. 2 is a cross-sectional view taken along line 2—2 of FIG. 1.

Turning initially to FIGS. 1 and 2, there is shown a first preferred embodiment of the present invention comprising a sunshade or umbrella 10, mounted on a pole or shank 12 which, in turn, is mounted generally upright on a floatable support member or platform 14. The umbrella or sunshade 10 is conventional and may be made of waterproof fabric stretched over and suitably attached to a series of circumferentially spaced, radial stringers or ribs fixed to shank 12 in the vicinity of end cap 18. Optionally, the usual slidable ferrule (not shown) to which the stringers are pivotally connected may be employed to raise or collapse the umbrella by sliding the ferrule up or down the shank as is well known in the umbrella art. As best seen in FIG. 2, the base of pole 12 of sunshade 10 is fixedly secured in a suitable manner within a recess 18 centrally disposed in the top or upwardly facing surface of platform 14. Thus, the pole's longitudinal axis is coincidental with respect to the central axis of the platform.

In accordance with the invention, support member or platform 14 is fabricated of a rigid, lightweight material capable of floating in water, i.e. the material has buoyancy characteristics. An open cell styrofoam plastic is the mostly preferred material; however, it will be understood that other known materials capable of providing buoyancy to sunshade 10 may be employed instead. Generally, support member 14 has a circular shape as shown with a rounded or convex peripheral edge. Here again, however, it will be understood that, if desired, other shapes may be employed instead such as, for example, square, rectangular, hexagonal, irregular, and so on. Hence, in the broadest aspect of the invention, support member 14 has an annular shape large enough and buoyant enough to provide a stable, floatable platform in water for sunshade or umbrella 10.

As best seen in FIG. 2, a cylindrical recess 20 is suitably formed in the underside or downwardly facing surface of the support member 14 and has a diameter less than the diameter of the support member substantially as depicted. By this arrangement, the support member will float or ride lower in the water than it otherwise would if it has a totally solid cross-sectional extent thereby providing increased stability and buoyancy.

The actual diameter of support member 14 will depend on the diameter of the umbrella or shade 10, the height of the umbrella above the support member (i.e. shank length), the weight of the umbrella components, and so on. Generally speaking, and without limitation, a ratio of 2:3 between support diameter and sunshade diameter for a sunshade shank length in the range of 3–6 feet has been found satisfactory with respect to buoyancy, stability, and resistance to tipping over in light breezes. To further reduce the weight of the sunshade and floatable support member assembly, shank 12 preferably comprises an aluminum tube having a longitudinally extending inner cavity 22.

Figure 6:
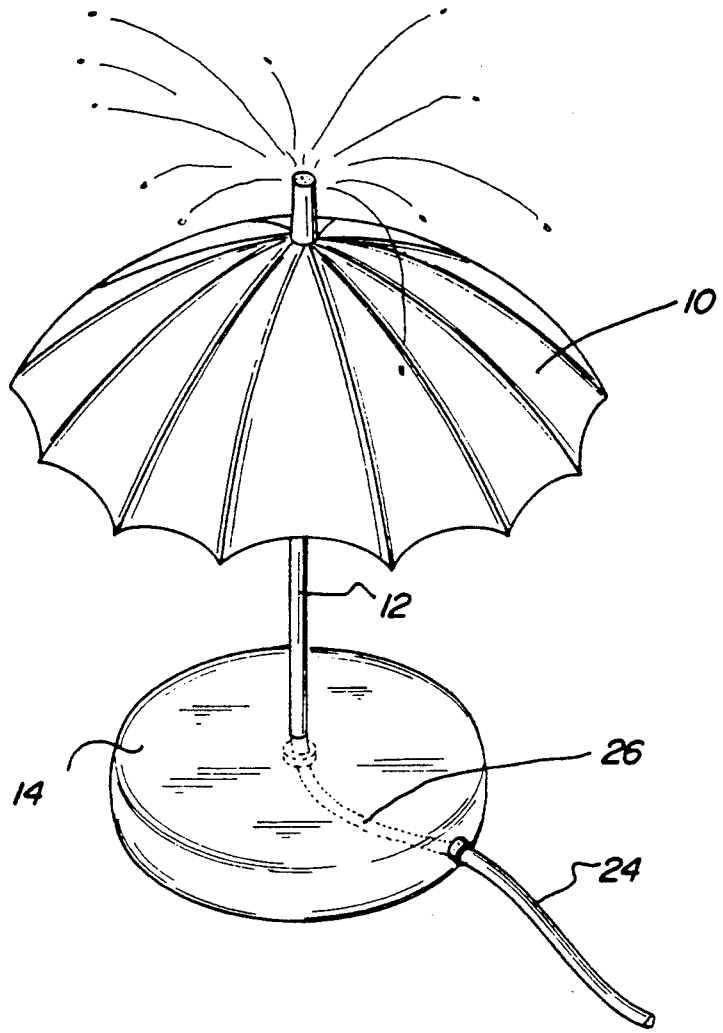
FIG. 6 is a perspective view in elevation of another preferred embodiment of the present invention.

Another advantage of providing such a tubular umbrella shank construction is the ability to channel a stream of water through the floating assembly by connecting a water hose 24 (e.g. a garden hose) to the support member 14. This alternatively preferred arrangement is shown in FIG. 6 where a flexible tubular connection 26 suitably is connected between the hose 24 and the bottom of tubular shank 12. In the embodiment of FIG. 6, end cap 18 is removable to permit the stream of water to flow out the top of shank 12 and spray the sunshade and surrounding area. This action will tend to further cool any swimmers holding onto platform 14 or otherwise bring enjoyment to the swimmers. It will be appreciated that hose 24 is coupled to a source of water pressure (not shown) such as a conventional tap faucet.

Figure 7:
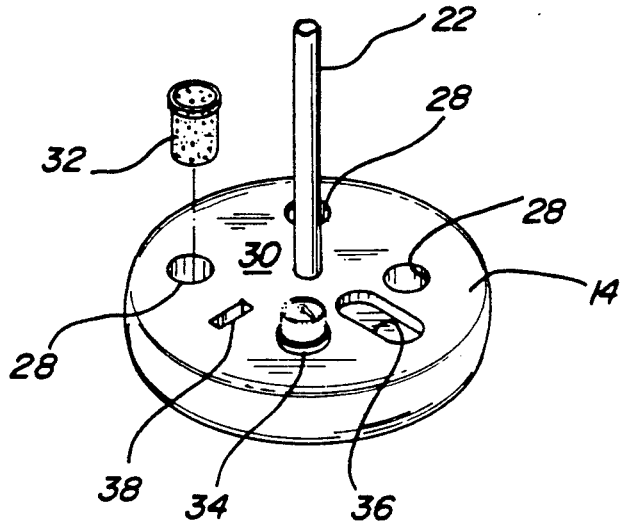
FIG. 7 is a perspective view in elevation of yet another preferred embodiment of the present invention shown partially broken away for the sake of clarity.

In another alternatively preferred arrangement, shown in FIG. 7, platform 14 is provided with a series of cylindrical recesses 28 in its upwardly facing surface 30. Recesses 28 are of suitable size to hold beverage cups or containers 32, cans 34 of soda pop, etc. Other recesses 36, 38 may also be provided in surface 30 suitably sized and shaped to hold sunglasses, suntan lotion containers, and so on. By utilizing recesses in the top surface 30 of support member 14, the floatable platform assembly of the invention becomes a convenient floating refreshment station or storage facility for swimmers and bathers.

Figure 8:
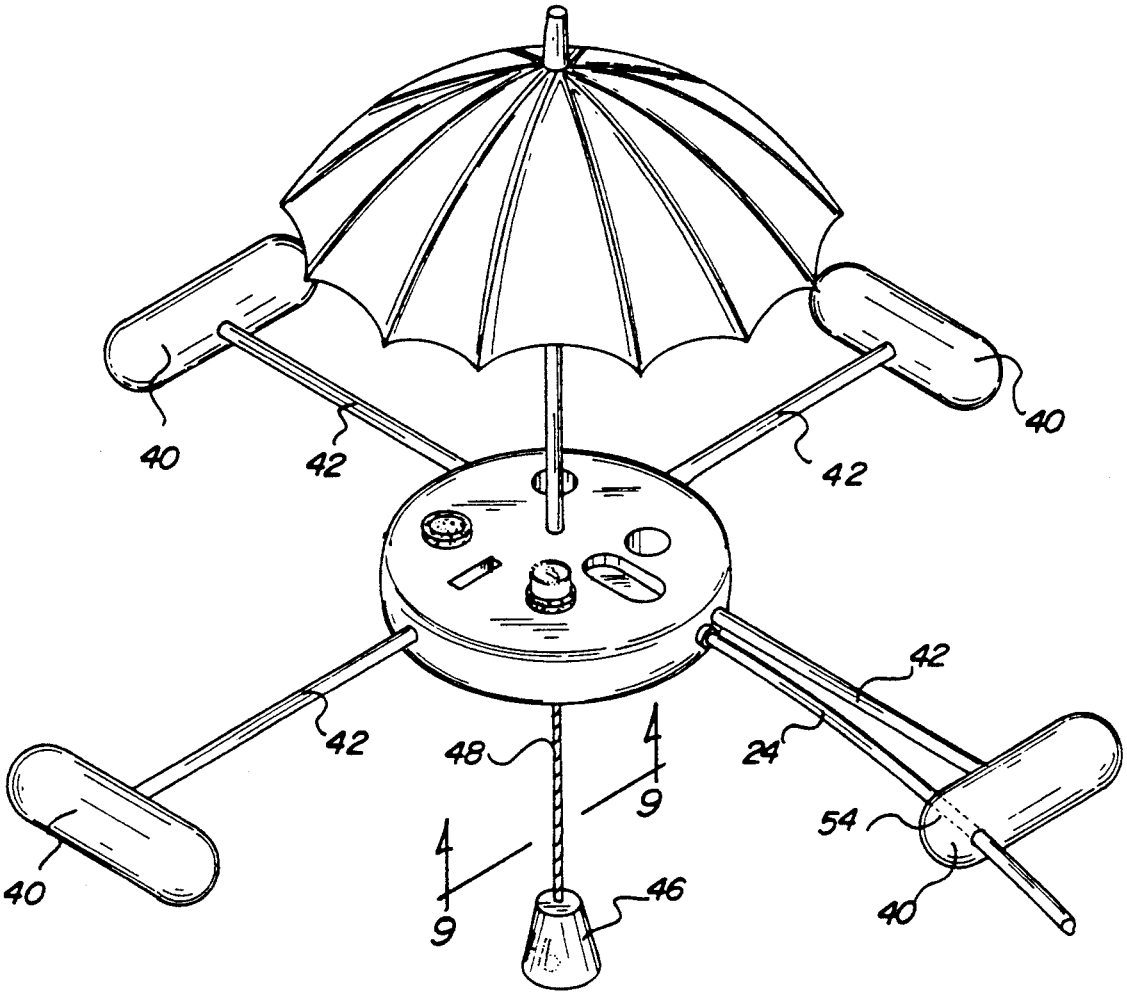
FIG. 8 is a perspective view in elevation of still yet another preferred embodiment of the present invention.
Figure 9:
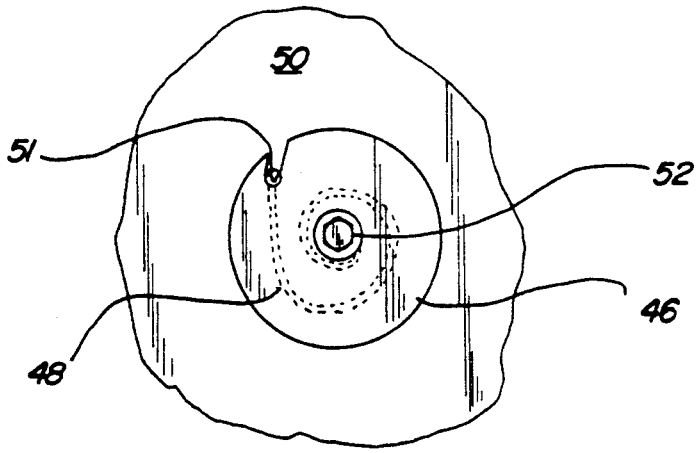
FIG. 9 is a plan view of a portion of the assembly shown in FIG. 8 taken along line 9—9 of FIG. 8.

To further enhance the stability and buoyancy of support member 14 (and therefore of sunshade 10), a series of outriggers may be provided as shown in the alternatively preferred embodiment of FIGS. 8 and 9. As shown therein, a series of outriggers 40 are suitably connected to platform 14 by a corresponding series of radial stringers 42. The outriggers 40 and the stringers 42 preferably are fabricated from the same buoyant material as support member 14, e.g. styrofoam plastic. In addition to the outriggers and stringers, a ballast in the form of weight 46 is connected to the underside of platform 14 substantially centrally thereof via flexible rope 48. As best seen in FIG. 9, one end of rope 46 is coiled and tightly maintained between clamping plate 48 and the undersurface 50 of platform 14 via a fastener bolt 52 threaded into a suitable female threaded bushing (not shown) suitably provided in the underside of support member 14 defining surface 50. Rope 46 is trained through a groove 51 located in the periphery of plate 46 and is held in tension by the action of weight 46 resting on the floor of the pool. In the event it is desired to adjust the length of flexible rope 48, the fastener 52 may be loosened and the coiled end of rope 48 played in or played out accordingly. The clamping plate 48 then is tightened against surface 50 via rotation of bolt fastener 52. In the foregoing manner, the embodiment of FIGS. 8 and 9 is adapted for use in swimming pools or other water locations of varying depth. The combination of the outriggers and stringers and the ballast weight renders platform 14 and its sunshade 10 firmly anchored in one location and relatively stable despite breezy weather, or rough water conditions due to heavy swimmer activity, or even "horseplay" in the vicinity of the floatable platform assembly. It will be noted in FIG. 8 that the hose connection 24 of FIG. 6 passes through a suitable hole 54 in one of the outriggers 46. This yet further stabilizes the floatable sunshade assembly of the invention.

Figure 3:
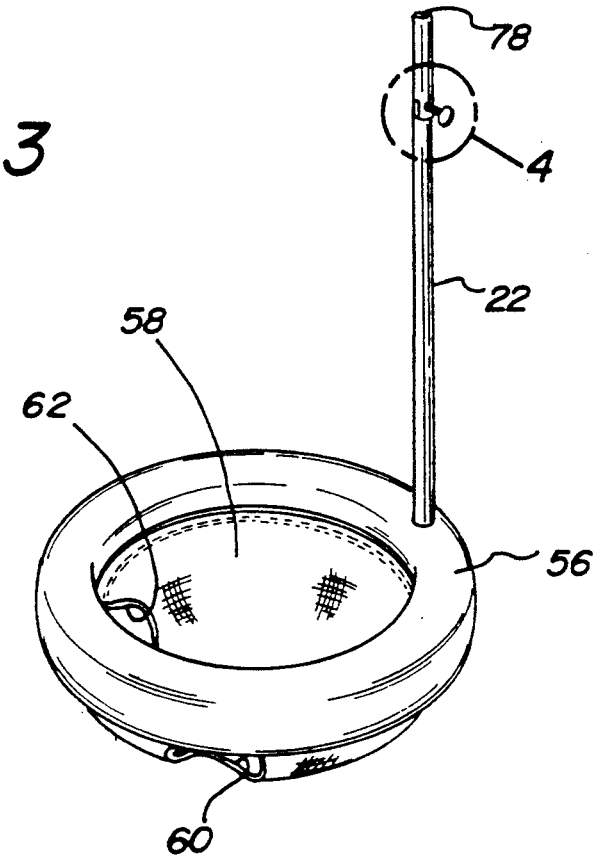
FIG. 3 is a perspective view in elevation of an alternative preferred form of the present invention shown partially broken away for clarity.
Figure 4:
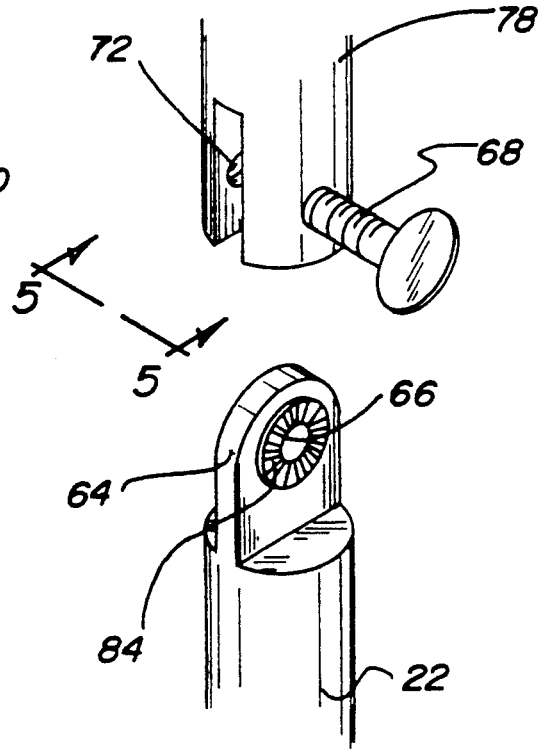
FIG. 4 is a perspective assembly view of a portion of the floatable sunshade assembly of FIG. 3.
Figure 5:
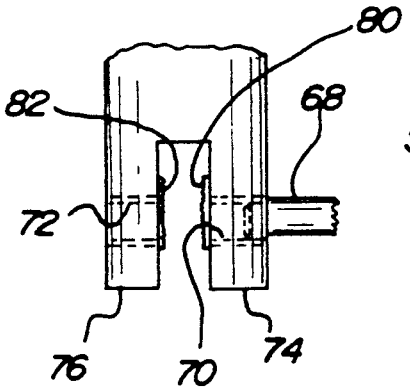
FIG. 5 is an elevational front view of a portion of the assembly of FIG. 4 taken along line 5—5 of FIG. 4.

Turning now to FIGS. 3–5 there is shown a further modified version of the present invention wherein the support structure 14 is replaced by a support structure or platform in the shape of a donut 56 having a downwardly depending dished central section 58 in which is disposed a pair of leg holes 60, 62. Shank 12 is affixed to donut 56 in an offset manner as shown and preferably is of solid aluminum material. In this embodiment, the shank is tiltable by virtue of the connection shown in FIGS. 4 and 5. A central upstanding tongue section 64 has a hole 66 therethrough to form an eyelet for receiving a threaded bolt fastener 68 adapted to extend through a pair of complementary aligned holes 70, 72 in the bifurcations 74, 76 of upper shank section 78 and threadedly engage female threads provided in hole 72. A pair of ridged washers 80, 82 affixed to bifurcations 74, 76 matingly engage with a corresponding pair of ridged washers 84 affixed to tongue 64 surrounding eyelet 66 in opposite sides thereof (only one is shown). By loosening bolt 68, upper section 78 may be caused to tilt relative to shank 22. The shank sections may then be tightened relatively to each other and maintained in their relatively tilted position by tightening bolt 68 in threaded recess 72 and causing ridged washers 80, 82 to matingly engage ridged washers 84 surrounding eyelet 66.

In the embodiment of FIGS. 3–5, a person may be seated in the dished central section 58 with his/her legs extending through holes 60, 62. This embodiment is very advantageous for an elderly person or an infant who wishes to bathe in a swimming pool and remain securely afloat as well as shaded from the harmful effects of the sun.

Figure 10:
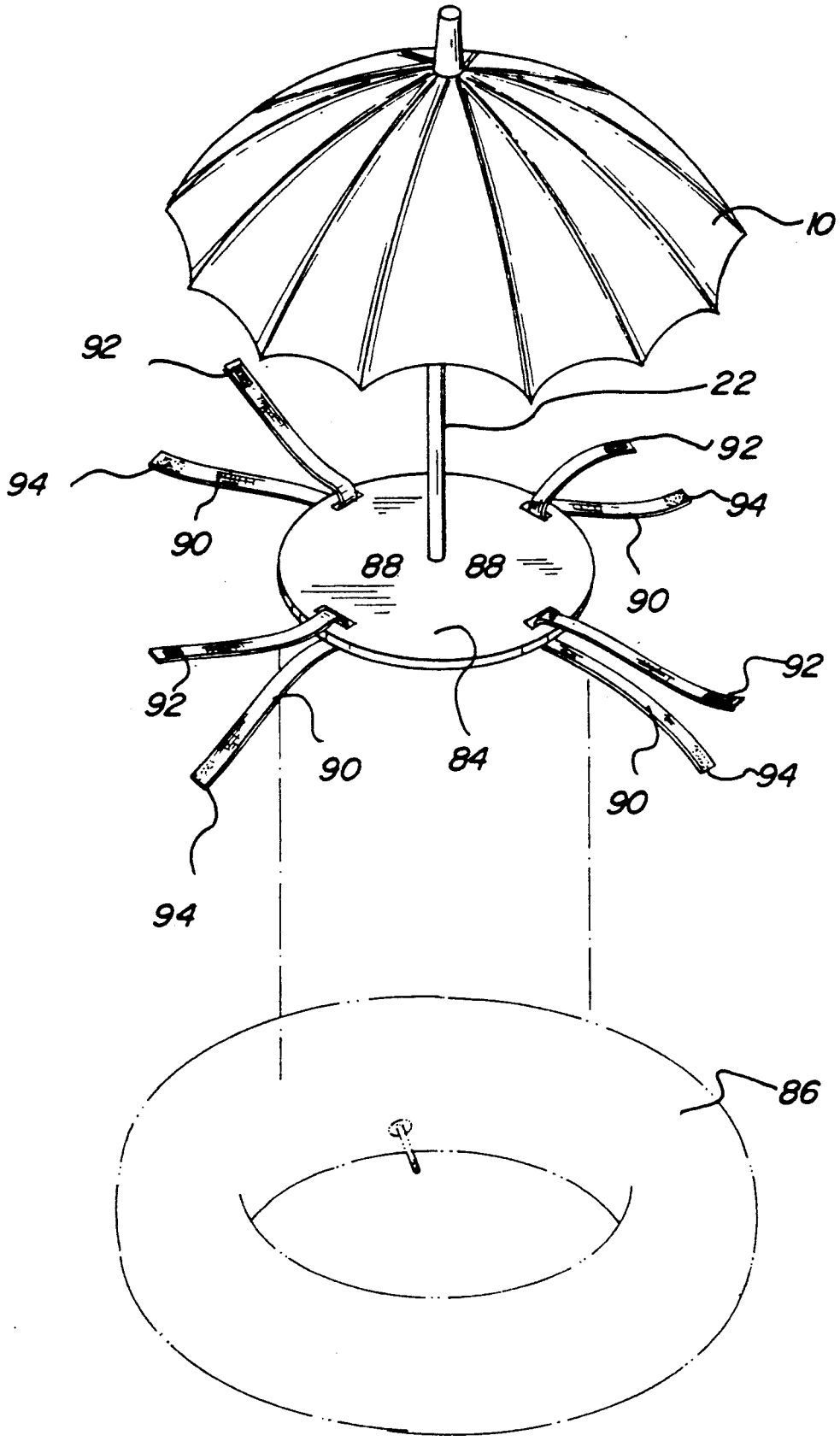
FIG. 10 is a perspective assembly view in elevation of yet still another preferred embodiment of the present invention.

In yet still another modification of the invention, namely, the alternatively preferred embodiment of FIG. 10, the floatable platform or support member comprises a flat plate 84 of generally circular shape adapted to be attached to a conventional inner tube 86 (indicated by broken lines). Attached centrally to flat plate 84 in any suitable manner is the base of pole 22 carrying the sunshade or umbrella 10. The circular plate 84 is sized nominally to fit the inside diameter of the inner tube and includes a series of substantially equiangularly spaced slots 88 located near the edge of the plate. The preferred material for plate 84 is aluminum; however, other materials such as plastic or wood, for example, may be used instead. Threaded through each slot 88 is a strap 90 having a pair of fastener elements 94, 96 one at each free end, respectively. The preferred fastener elements are fabric mating elements such as those sold under the registered trademark VELCRO; however, other fastener elements such as mating snap fasteners, or belt buckles, may be used instead. Suffice it to say, each strap 90 is long enough so that it may be wrapped around the inner tube and its free ends securely fastened together when the flat plate is fitted within the inner tube's inside diameter (i.e. central opening). By this action, the flat plate 84 and the sunshade or umbrella 10 will be securely attached to and nestled within the inner tube's central opening thus forming a floatable sunshade assembly that is relatively inexpensive to fabricate.

In summary, there has been fully disclosed above a floatable sunshade assembly in various forms capable of achieving all of the objects and advantages of the invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth. Hence, the proper scope of the present invention should be determined only by the broadest interpretation of the appended claims so as to encompass all such modifications and equivalents.

What is claimed as being new and desired to be protected by Letters Patent of the United States is as follows:

1. A floatable sunshade assembly comprising in combination:

a floatable sunshade assembly comprising in combination:

a sunshade mounted on a pole, and a support member, said support member being floatable in water, said pole and said sunshade mounted thereon being carried by said support member in an upright manner, wherein said support member is styrofoam plastic, wherein said floatable support member is circular in shape and has a convex peripheral edge, said support member having an upper surface and a lower surface, said pole being fixed to said support member on said upper surface, and a central recess disposed in said lower surface having a diameter less than the diameter of said support member, wherein said sunshade pole has a hollow interior, said support member further having a conduit extending between the periphery of said support member and the bottom of said pole, a water carrying hose coupled to said conduit at the periphery of said support member for supplying water under pressure to said hollow interior of said pole, further comprising at least one stringer extending radially outwardly from said support member, said stringer terminating in an outrigger having buoyancy characteristics whereby said stringer and said outrigger enhances the floatability of said support member, and wherein said water carrying hose extends through an opening provided in said at least one stringer.

2. The invention of claim 1 further comprising ballast means connected to said support member, said ballast means comprising weight means, and means connecting said support member to said weight means.

* * * * *